US010421640B2

(12) United States Patent
Fargo

(10) Patent No.: US 10,421,640 B2
(45) Date of Patent: Sep. 24, 2019

(54) ELEVATOR BRAKING DEVICE INCLUDING BUCKLING BEAMS

(71) Applicant: OTIS ELEVATOR COMPANY, Farmington, CT (US)

(72) Inventor: Richard N. Fargo, Plainville, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 280 days.

(21) Appl. No.: 15/436,071

(22) Filed: Feb. 17, 2017

(65) Prior Publication Data

US 2018/0237263 A1 Aug. 23, 2018

(51) Int. Cl.
*B66B 5/18* (2006.01)
*B66B 5/22* (2006.01)
*B66B 5/16* (2006.01)

(52) U.S. Cl.
CPC ..... *B66B 5/18* (2013.01); *B66B 5/16* (2013.01); *B66B 5/22* (2013.01)

(58) Field of Classification Search
CPC ..... B66B 5/18; B66B 5/16; B66B 5/22
See application file for complete search history.

(56) References Cited

U.S. PATENT DOCUMENTS 1,934,508 A 11/1933 McCormick
4,512,444 A * 4/1985 Koppensteiner ..... B66B 5/28 104/254
4,538,706 A 9/1985 Koppensteiner
5,159,995 A 11/1992 Sissala et al.
5,230,406 A * 7/1993 Poon ..... B66B 5/22 187/376
5,238,088 A 8/1993 Yoo
5,358,079 A 10/1994 Brown
5,370,208 A 12/1994 DeJong
6,804,036 B1 10/2004 Chen et al.
7,134,529 B2 11/2006 Maury
7,575,099 B2 8/2009 Oh et al.
2003/0205008 A1 11/2003 Sridhara
2007/0007083 A1* 1/2007 Husmann ..... B66B 5/20 187/366
2008/0156590 A1 7/2008 Ericson
2012/0222918 A1* 9/2012 Billard ..... B66B 5/22 187/359

(Continued)

FOREIGN PATENT DOCUMENTS

CN 200978898 Y 11/2007
CN 101142135 A 3/2008
CN 101712429 A 5/2010

(Continued)

OTHER PUBLICATIONS

Extended European Search Report for Application No. EP 18 15 7498 dated Jul. 12, 2018.

(Continued)

*Primary Examiner* — Michael A Riegelman
(74) *Attorney, Agent, or Firm* — Carlson, Gaskey & Olds

(57) ABSTRACT

An illustrative example elevator brake device includes a housing that supports a brake member. The brake member has a braking surface. The brake member is moveable between a disengaged position and an engaged position. A plurality of buckling beams are situated to urge the brake member to apply a braking force.

20 Claims, 10 Drawing Sheets

(56) References Cited

U.S. PATENT DOCUMENTS

| | | | |
|---|---|---|---|
| 2016/0325964 | A1 | 11/2016 | Haapaniemi et al. |
| 2016/0325965 | A1 | 11/2016 | Haapaniemi et al. |

FOREIGN PATENT DOCUMENTS

| | | | |
|---|---|---|---|
| CN | 102132063 | A | 7/2011 |
| CN | 202030413 | U | 11/2011 |
| CN | 102431864 | A | 5/2012 |
| CN | 204660698 | U | 9/2015 |
| CN | 107039612 | A | 8/2017 |
| EP | 1061032 | A1 | 12/2000 |
| EP | 2177815 | A2 | 4/2010 |
| GB | 2136773 | A | 9/1984 |
| JP | 2001341957 | A | 12/2001 |
| JP | 2004224492 | A | 8/2004 |
| JP | 2011105461 | A | 6/2011 |
| JP | 2015067377 | A | 4/2015 |
| WO | 2004/067430 | A1 | 8/2004 |
| WO | 2006/087453 | A1 | 8/2006 |

OTHER PUBLICATIONS

Search Report for CN Application 201810149691X dated May 14, 2019.

* cited by examiner

ELEVATOR BRAKING DEVICE INCLUDING BUCKLING BEAMS

BACKGROUND

Elevator systems include various devices for controlling movement of an elevator car. Under normal operating conditions, the elevator machine is responsible for controlling movement of the elevator car. Occasionally, an undesirable over speed condition may exist. Elevator systems include governor devices that operate auxiliary brakes or safeties to stop elevator car movement under such circumstances. A variety of such brakes are known.

Most safeties engage the guiderail along which the elevator car travels. Some safeties include rollers while others include wedge-shaped components that engage the guiderail to apply a braking force for preventing movement of the elevator car. Some safeties include some form of spring or biasing element to urge the brake components into engagement with the guiderail. For example, a set of disk-shaped springs are stacked under compression for urging the brake member in a direction toward the guiderail when braking engagement is desired. One drawback associated with such spring arrangements is that the force applied by the springs varies with the amount of spring deflection. A more consistent force application would be an improvement. Another drawback associated with such spring arrangements is the hysteresis that occurs because of internal friction between the disks and the friction associated with contact between the disk surfaces and the brake member. Eliminating such hysteresis would be an improvement.

SUMMARY

An illustrative example elevator brake device includes a housing that supports a brake member. The brake member has a braking surface. The brake member is moveable between a disengaged position and an engaged position. A plurality of buckling beams are situated to urge the brake member to apply a braking force.

An example embodiment having one or more features of the device of the previous paragraph includes a brake member support. The brake member support is moveable relative to the housing in a first direction corresponding to movement of the brake member between the disengaged position and the engaged position. The plurality of bucking beams urge the brake member in a second direction to apply the braking force. The second direction is generally perpendicular to the first direction.

In an example embodiment having one or more features of the device of any of the previous paragraphs, each of the plurality of buckling beams comprises a sheet of flexible material, the sheet has a length, a width, and a thickness, the length is greater than the width and the width is greater than the thickness, and the sheet is situated relative to the brake member with the length generally parallel to a direction that the buckling beams urge the brake member to apply the braking force.

In an example embodiment having one or more features of the device of any of the previous paragraphs, each sheet is rectangular.

In an example embodiment having one or more features of the device of any of the previous paragraphs, the thickness is approximately 1% of one of the length or the width.

In an example embodiment having one or more features of the device of any of the previous paragraphs, each sheet has a rest position in which the sheet is flat and situated in a single plane, two edges of the sheet are separated by the length in the rest position and each sheet is deflected into a curved shape with the two edges of the sheet separated by a distance that is less than the length to urge the brake member to apply the braking force.

In an example embodiment having one or more features of the device of any of the previous paragraphs, the flexible material comprises metal.

In an example embodiment having one or more features of the device of any of the previous paragraphs, the brake member support includes at least one recess facing toward the brake member, the brake member includes at least one recess on a side facing opposite the braking surface, the plurality of buckling beams include a first edge situated in the recess on the brake member support and a second, opposite edge situated in the recess on the brake member, and a distance between the first and second edges is less than the length.

In an example embodiment having one or more features of the device of any of the previous paragraphs, the buckling beams provide a consistent force in a direction of urging the brake surface to apply the braking force.

In an example embodiment having one or more features of the device of any of the previous paragraphs, the plurality of buckling beams includes at least 100 bucking beams.

In an example embodiment having one or more features of the device of any of the previous paragraphs, the plurality of buckling beams are arranged in a plurality of stacks.

An example embodiment having one or more features of the device of any of the previous paragraphs includes a tensioning member received against at least one of the plurality of bucking beams in a position where the tensioning member maintains at least some of the plurality of buckling beams in a deflected state.

An example embodiment having one or more features of the device of any of the previous paragraphs includes a force applying assembly including the plurality of buckling beams and a plurality of arms, wherein the buckling beams are situated to urge first ends of the arms away from each other and second, opposite ends of the arms toward each other.

In an example embodiment having one or more features of the device of any of the previous paragraphs, the plurality of arms are situated relative to the brake member such that the second ends of the arms urge the brake member in a direction to apply the braking force.

An example embodiment having one or more features of the device of any of the previous paragraphs includes a tensioning member having a strut between the arms closer to the first ends of the arms than the second ends of the arms, the tensioning member including at least one structural element in contact with at least one of the buckling beams to deflect at least some of the buckling beams in a desired direction.

In an example embodiment having one or more features of the device of any of the previous paragraphs, each of the arms includes at least one recess near the first end and the buckling beams have edges received in the notches, respectively.

In an example embodiment having one or more features of the device of any of the previous paragraphs, the buckling beams each comprise a sheet of flexible material comprising at least one of metal or carbon.

In an example embodiment having one or more features of the device of any of the previous paragraphs, the buckling beams each comprise a carbon pultrusion.

In an example embodiment having one or more features of the device of any of the previous paragraphs, each of the buckling beams comprises a sheet of flexible material that has a preselected curvature in a rest condition.

Various features and advantages of at least one disclosed example embodiment will become apparent to those skilled in the art from the following detailed description. The drawings that accompany the detailed description can be briefly described as follows.

DETAILED DESCRIPTION

Elevator brake devices designed according to an embodiment of this invention include buckling beams that urge a brake member to apply a braking force. The buckling beams provide a nearly constant force on the brake member over the entire stroke of the brake member. The buckling beams require less space and weigh less than other spring arrangements while providing superior performance.

The term "buckling beam" as used in this document should be understood as a compression member having a load applied to ends of the compression member, used in a deflected condition or form, to maintain a force near to the buckling load. Compression members that are useful as buckling beams in embodiments of this invention will be relatively long and thin having a length that is significantly longer than a shortest cross-sectional dimension of the member, which is in a direction generally perpendicular to the length. For example, a compression member in some embodiments has a length that is more than 100 times the smallest cross-sectional dimension of that compression member.

Figure 1:
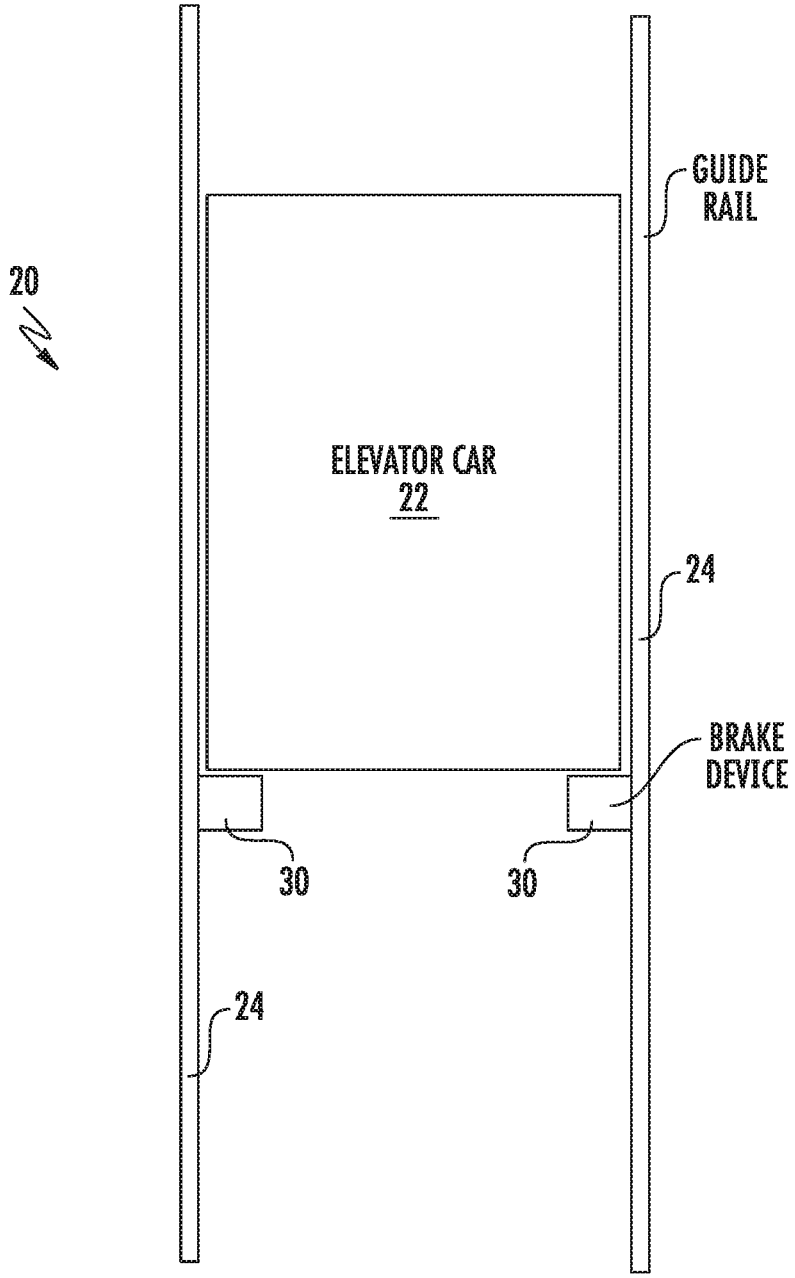
FIG. 1 schematically illustrates selected portions of an elevator system including a brake device designed according to an embodiment of this invention.

FIG. 1 schematically illustrates selected portions of an elevator system 20 that includes an embodiment of this invention. An elevator car 22 is supported for movement along guiderails 24 in a generally known manner. Brake devices 30 are associated with the elevator car 22 to control movement of the car. In some embodiments, the brake devices 30 are safeties that are used in over speed conditions or other situations in which it is desirable to prevent movement of the elevator car 22.

Figure 2:
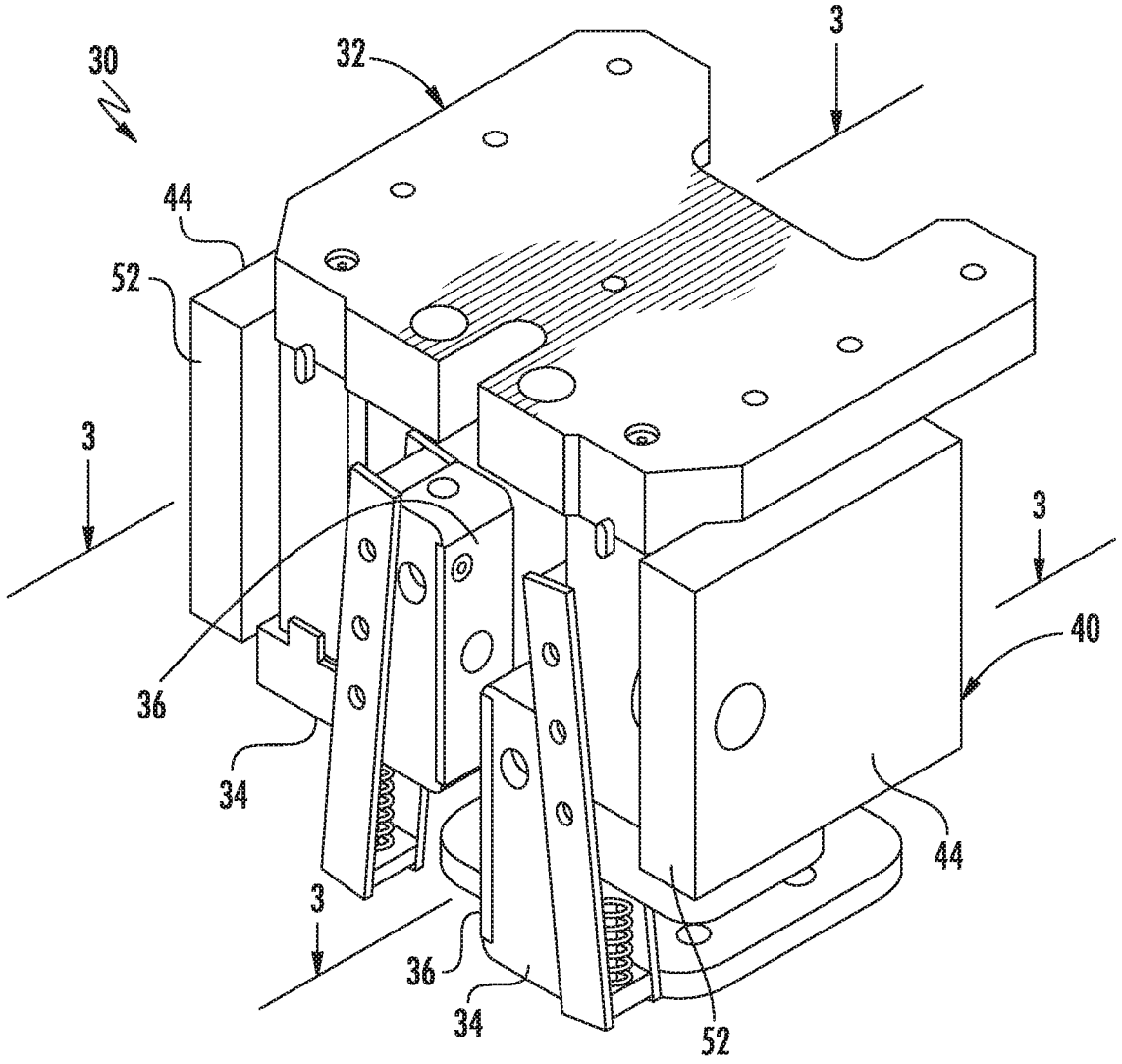
FIG. 2 diagrammatically illustrates, in perspective view, an example brake device designed according to an embodiment of this invention.
Figure 3:
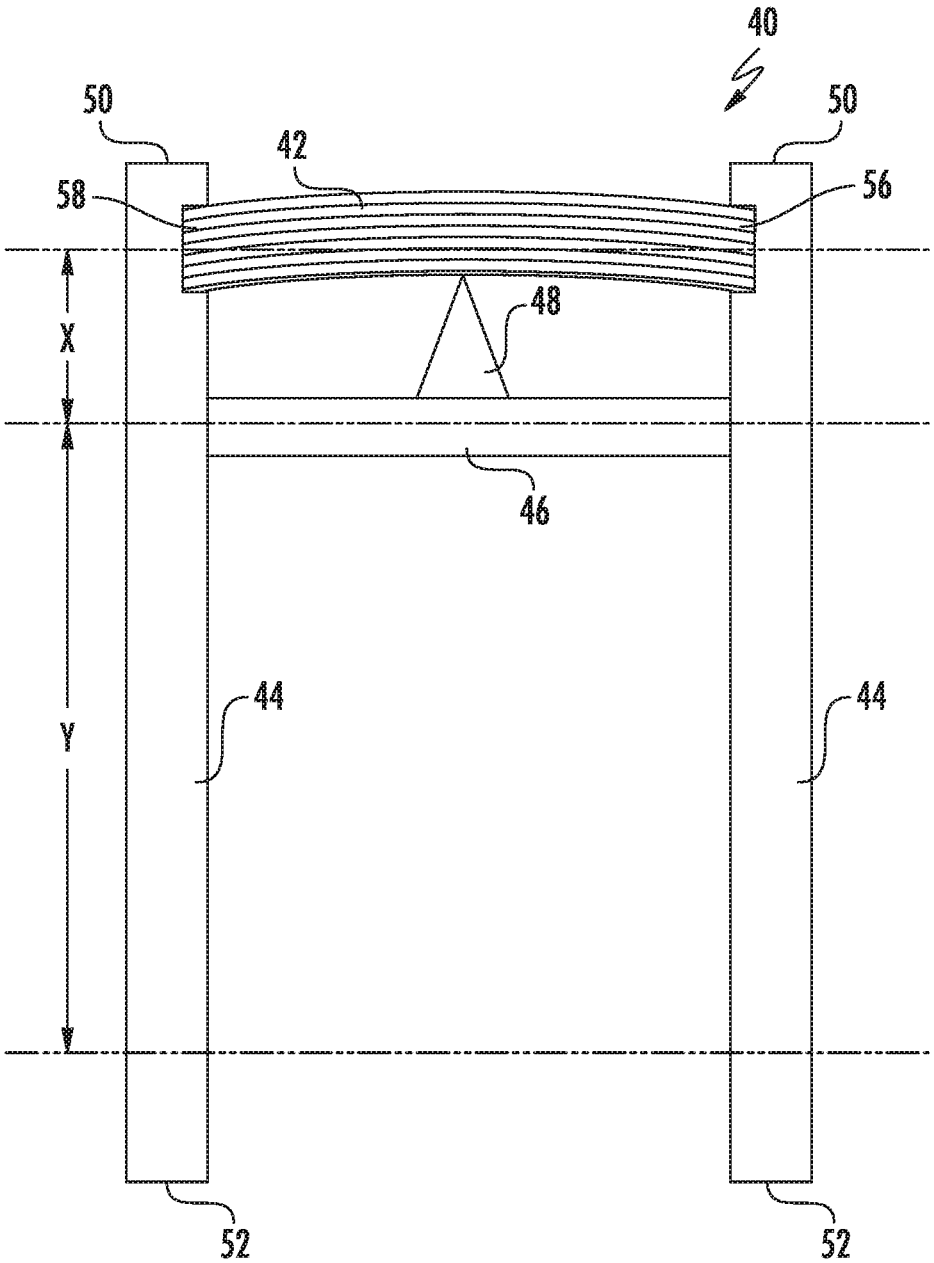
FIG. 3 is a schematic, partial cross-sectional illustration taken along the lines 3-3 in FIG. 2 showing selected portions of that embodiment.

One example embodiment of a brake device 30 is shown in FIGS. 2 and 3. This example brake device 30 includes a housing 32 that supports brake members 34 that are moveable between disengaged and engaged positions. The brake member 34 on the right side of the drawing is shown in a disengaged position. That brake member 34 could move upward (according to the drawing) into an engaged position where braking surfaces 36 of the brake members 34 are situated to engage the guiderail 24 to apply a braking force to prevent movement of the elevator car 22.

As best appreciated from FIG. 3, the brake device 30 includes a brake force applying assembly 40 that provides a force for urging the brake members 34 in a direction to apply a braking force. In particular, the brake force applying assembly 40 provides a force in a direction that is normal to the braking surfaces 36 to urge those surfaces into engagement with the guiderail 24 in this example.

The brake force applying assembly 40 includes a plurality of buckling beams 42 situated between side arms 44. A tensioning member 46 includes a structural component 48 that is in contact with at least one of the buckling beams 42. The tensioning member 46 ensures that the buckling beams 42 are pre-tensioned by being at least partially deflected from a flat, rest position. With the buckling beams 42 under tension, the buckling beams 42 tend to urge first ends 50 of the side arms 44 apart and second ends 52 of the side arms 44 toward each other.

The tensioning member 46 includes a central portion or strut that is connected at its ends to the side arms 44, which is done by welding in some embodiments. In some examples, the central portion or strut of the tensioning member 46 is at least somewhat flexible and its bending moment may contribute a small percentage to the normal force applied to urge the brake members 34 for applying a braking force.

One feature of the example configuration shown in FIG. 3 is that it provides an essentially constant normal force urging the braking surfaces 36 into engagement with a guiderail 24. Using $F_b$ to represent the compression force of the buckling beams 46, $M_c$ to represent the bending moment introduced by the tensioning member 46, and $F_s$ for the normal force, the sum of the moments on one side in FIG. 3 is:

$$M_c+F_b*x-F_s*y=0.$$

Figure 4:
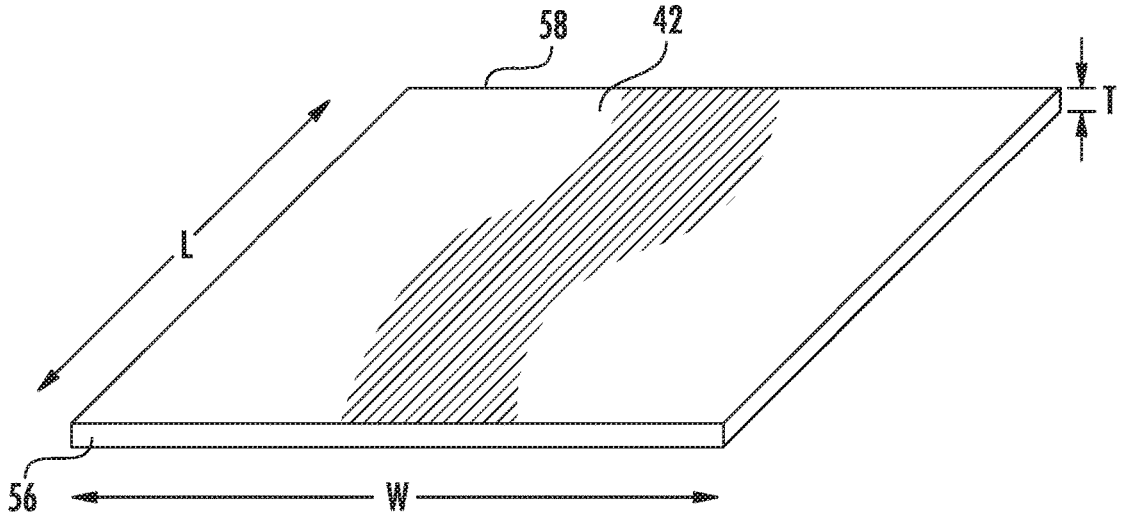
FIG. 4 diagrammatically illustrates an example buckling beam.

FIG. 4 shows an example buckling beam 42. In this example, the buckling beams each comprise a generally flat sheet of flexible material. Example materials include metal, steel, or carbon fiber pultrusions. Each buckling beam 42 has a length L that is greater than a width W. A thickness T is much less than the length and the width. In some examples, the length is about 20% greater than the width and the thickness is about 1% of the width. In one example embodiment, the length is 35 mm, the width is 30 mm and the thickness is 0.3 mm. In such an example, the length is more than 100 times the thickness, which is the smallest cross-sectional dimension.

While the example compression member or buckling beam of FIG. 4 is a generally rectangular and flat component, other embodiments have different configurations. In some embodiments, the buckling beams comprise rods or cylindrical bodies. Given this description, those skilled in the art will be able to select an appropriate compression member configuration to meet their particular needs.

Figure 5:
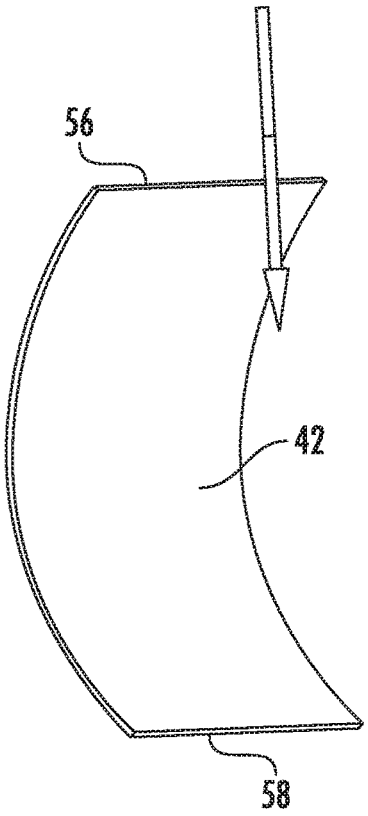
FIG. 5 illustrates another example buckling beam.

The buckling beams 42 have edges 56 and 58 that are spaced apart by the length L when the flexible sheet is in a planar, generally flat, rest or relaxed condition. As shown in FIG. 5, other example buckling beams 42 are pre-deflected and curved in a rest condition.

One feature of the buckling beams 42 is that they provide an essentially constant force for urging the brake members 34 to apply a braking force over a range of deflection of the buckling beams 42 corresponding to the entire expected stroke of the brake members 34. FIG. 6 graphically illustrates a relationship between the force applied by the buckling beams 42 and an amount of deflection of the buckling beams. A plot 60 includes a first curve 62 that represents the forced applied by the buckling beams 42 over a range of deflection. As can be appreciated from the drawing, at different amounts of deflection (a through d), the force changes only slightly.

Figure 6A:
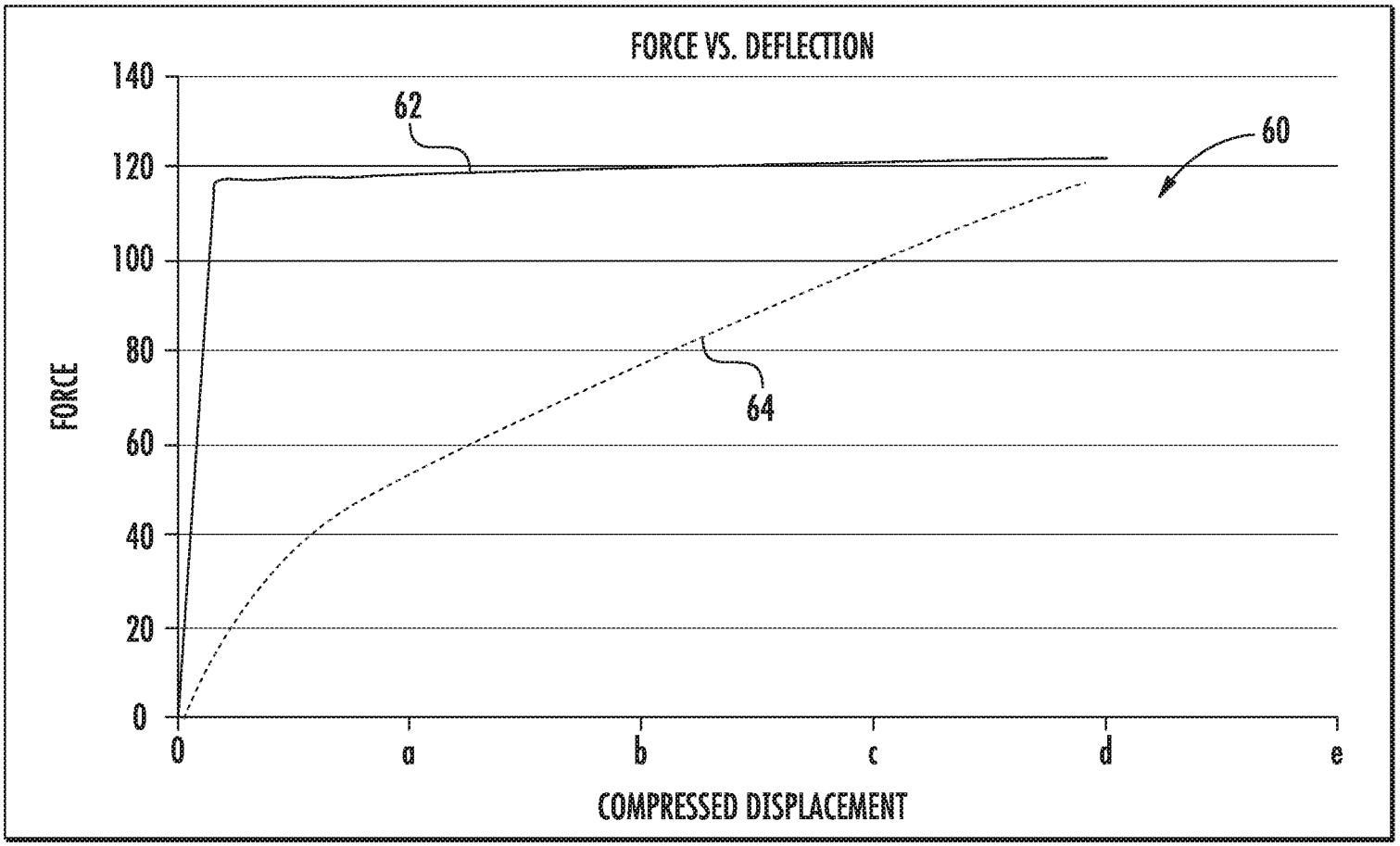
FIG. 6A graphically illustrates a relationship between force and deflection.

In one example embodiment represented by FIG. 6A, the buckling beams 42 apply a force of approximately 120 N over a range of deflection between 0.5 mm and 2.0 mm. For some example brake devices, a variation in force application of a few percent is sufficiently consistent to achieve a consistent braking force for stopping the elevator car during safety activation for various conditions of the braking surfaces 36, which may wear over time.

FIG. 6A includes another plot 64 of the force applied by another type of spring arrangement, such as disk springs. As can be appreciated from the drawing, the difference between the buckling beams 42 and disk springs represented by the curve 64 is significant. There is a continuous change in the amount of force provided by the disk springs over the range of deflection represented in FIG. 6A. By contrast, after a small amount of deflection (e.g., 0.005 mm), the buckling beams provide an essentially constant force across the stroke of the brake members 34 compared to the continuously changing amount of force provided by a disk spring arrangement.

One feature of having a consistent force available from the buckling beams 42 is that a smaller amount of deflection is necessary to maintain a consistent force over a range of brake stroke, which can vary over time. Requiring a smaller amount of deflection of the buckling beams 42 compared to other spring arrangements requires less space within an elevator hoistway compared to previous brake designs.

The configuration of the buckling beams allows for less mass, which reduces the weight of the brake device. Space savings and weight reductions within elevator systems are recognized as desirable for more efficient use of space and energy within elevator systems. A brake device designed according to this invention facilitates accomplishing those goals.

Figure 6B:
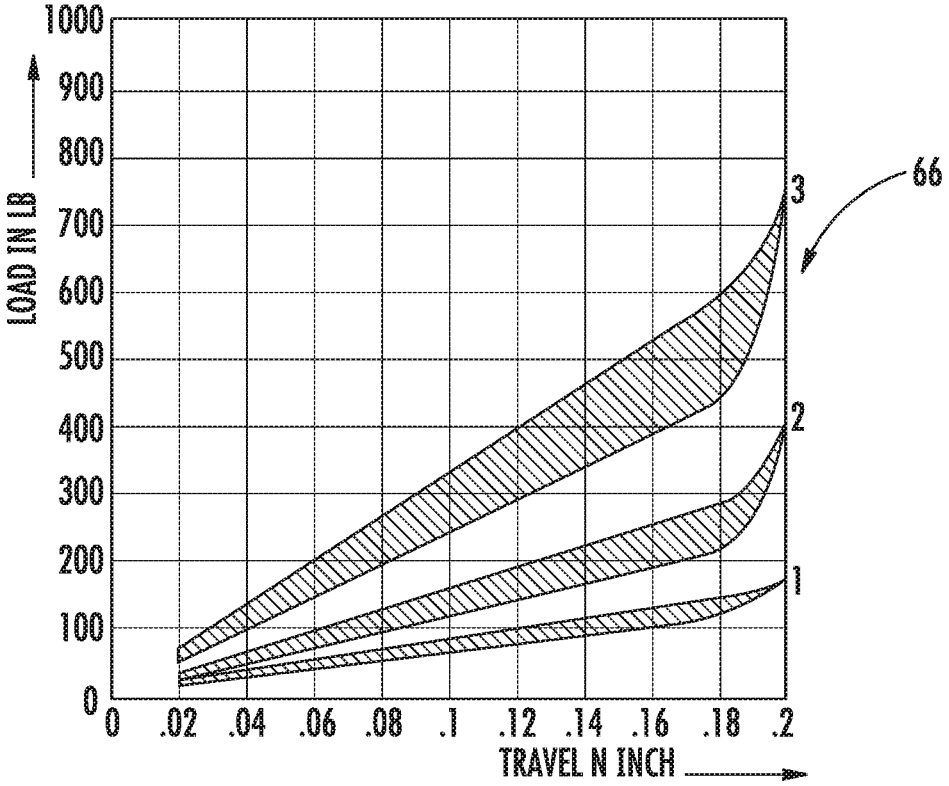
FIG. 6B PRIOR ART
FIG. 6B graphically illustrates a hysteresis effect that occurs in some prior art devices.

Another feature of the buckling beams 42 is that their ends 56, 58 are engaging recesses on the side arms 44, which avoids the friction and hysteresis associated with disk-shaped springs. FIG. 6B includes a plot 66 demonstrating the type of hysteresis that occurs when Belleville washer type springs are included in an elevator safety. The friction between the washer springs introduces the hysteresis effect. Buckling beams with load applied to their ends do not have such hysteresis. Also, the buckling beam end engagement avoids energy loss otherwise associated with disk-shaped springs.

Figure 7:
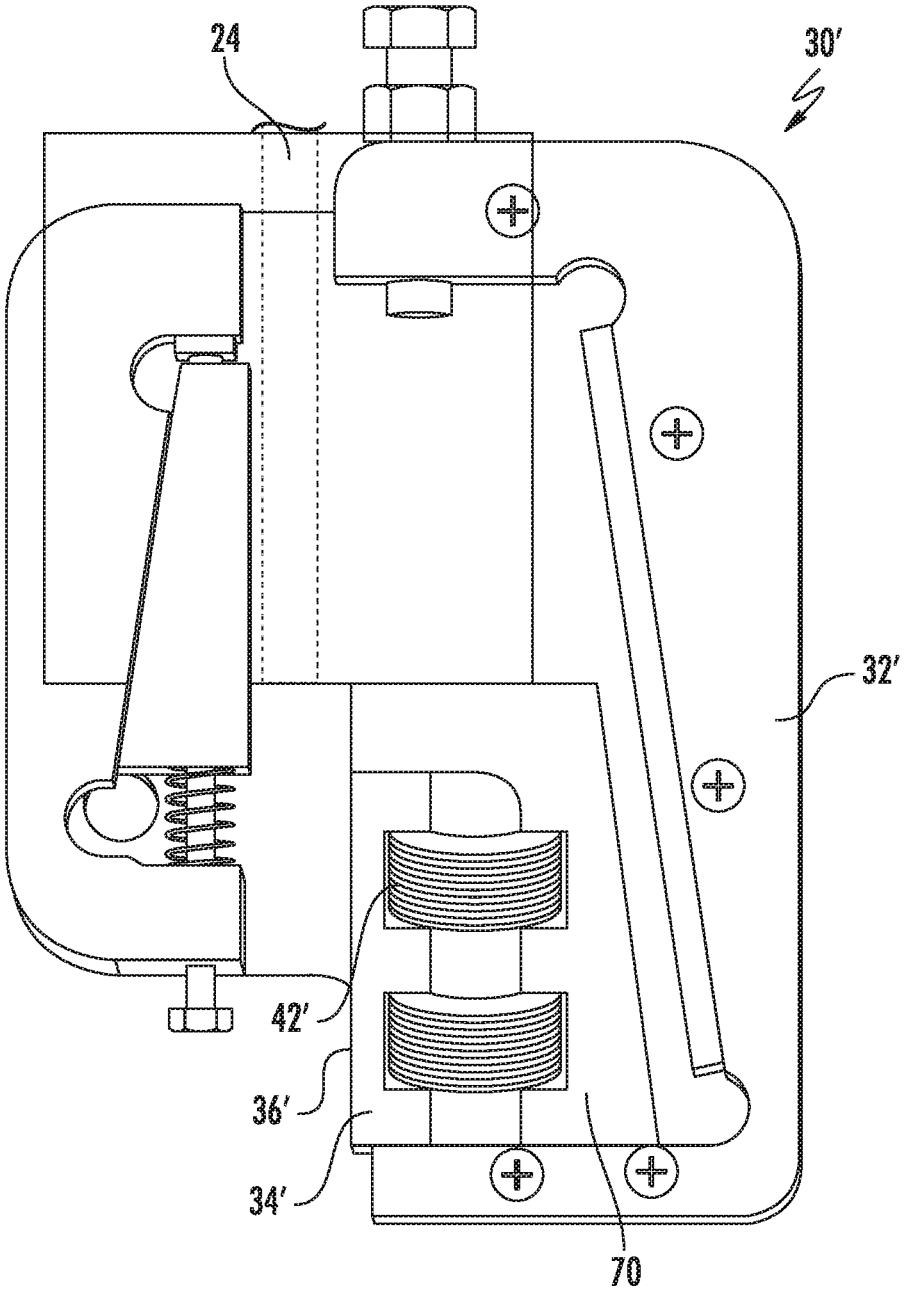
FIG. 7 diagrammatically illustrates another example embodiment of a brake device designed according to this invention in a first condition.
Figure 8:
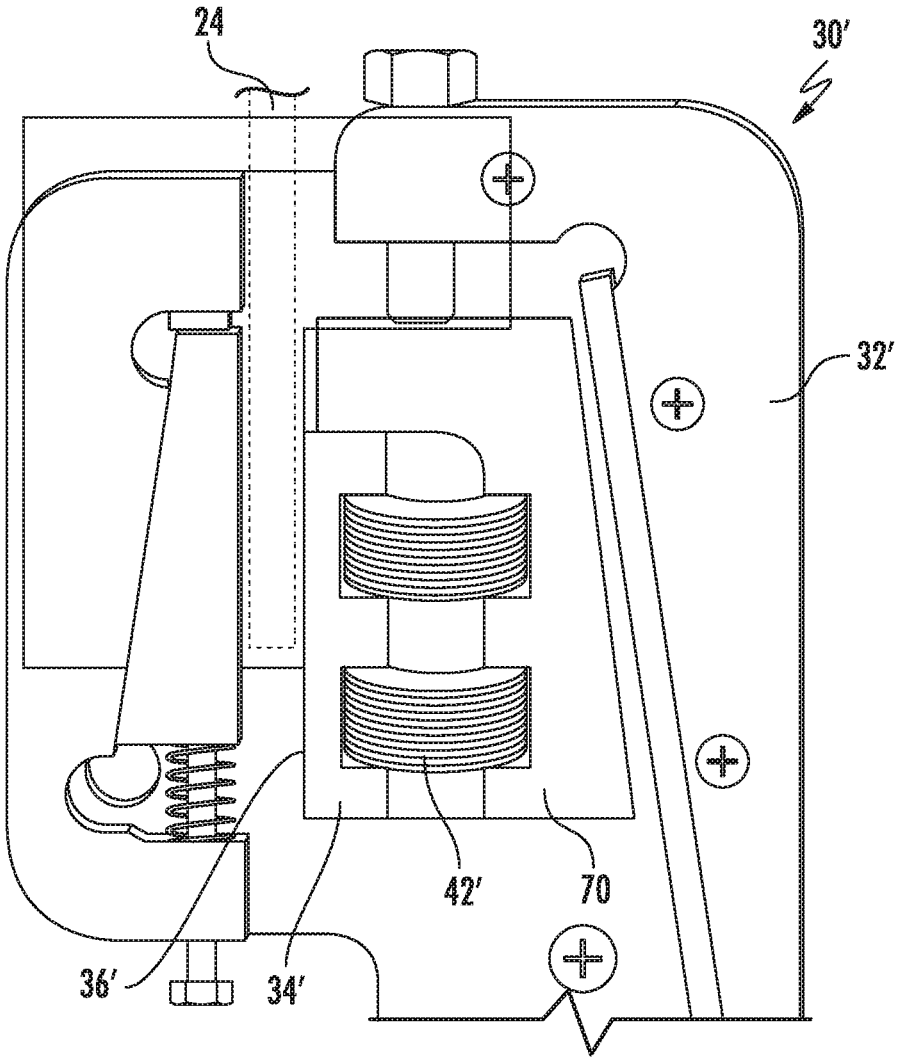
FIG. 8 illustrates the example of FIG. 7 in another condition.

FIGS. 7 and 8 illustrate another example brake device designed according to an embodiment of this invention. In this example, a plurality of buckling beams 42' are situated between the brake member 34' and a brake member support 70. In this embodiment, the buckling beams 42' urge the brake member 34' away from the brake member support 70. Although not specifically illustrated, the brake device 30' of FIGS. 7 and 8 includes one or more retention features that prevent the brake member 34' from being completely separated from the brake member support 70 in a manner similar to how known brake devices maintain the brake member in a desired range of positions. FIG. 7 shows the brake member 34' in a disengaged position while FIG. 8 shows the brake member 34' in an engaged position where it is capable of engaging the guiderail 24 to apply a braking force to prevent movement of the elevator car 22.

Figure 9:
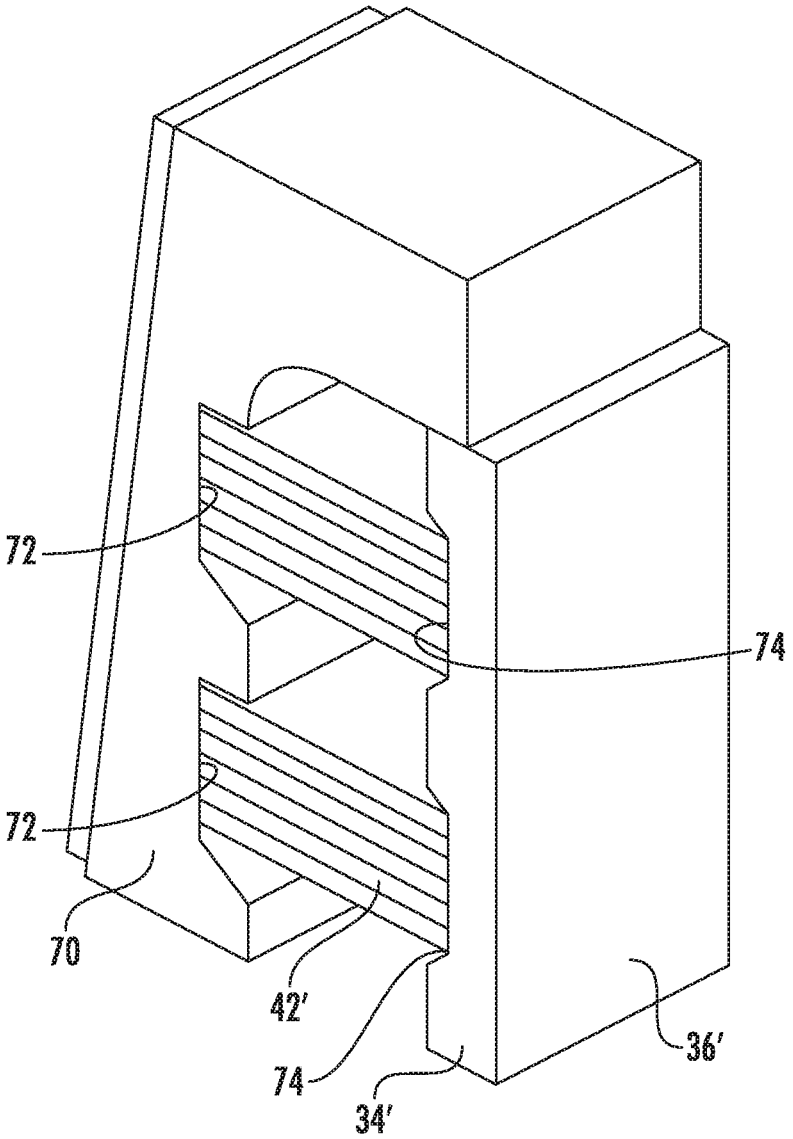
FIG. 9 diagrammatically illustrates, in perspective view, selected components of the embodiment of FIGS. 7 and 8 with the buckling beams in a first condition.
Figure 10:
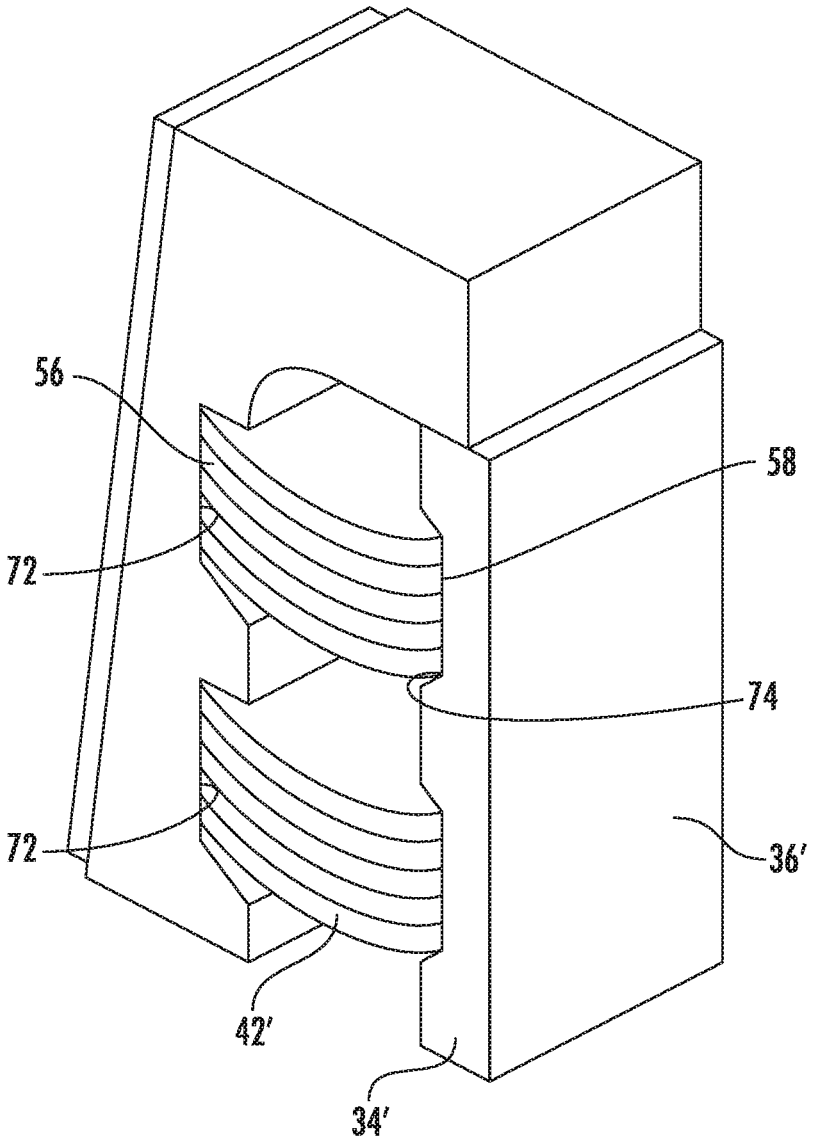
FIG. 10 schematically illustrates the components shown in FIG. 9 with the buckling beams in a second condition.

As can best be appreciated from FIGS. 9 and 10, the edges 56 and 58 are received in recesses 72 and 74, respectively. In this example embodiment, two recesses 72 are provided on the brake member support 70 and two recesses 74 are provided on a side of the brake member 34' that faces opposite from the braking surface 36'. FIG. 9 represents the buckling beams 42' in a relaxed, flat condition. FIG. 10 shows the buckling beams 42' partially deflected and under tension for urging the brake member 34' in a direction to apply a braking force. The recesses 72 and 74 in this embodiment includes sloped surfaces (along the bottom of the notches according to the drawing) to accommodate deflecting of the buckling beams 42'. In this example, the sloped surfaces on the recesses 72 and 74 serve to limit an amount of deflection of the buckling beams 42' to control the relative positions between the brake member support 70 and the brake member 34'.

While two example embodiment brake devices are mentioned above, those skilled in the art who have the benefit of this description will realize that other embodiments including buckling beams situated like those in the example embodiments may be useful in a variety of elevator systems. Moreover, the various features of the different embodiments are not necessarily exclusive to the embodiment with which they are shown. Variations and different combinations of the features from the disclosed embodiments may be utilized to realize other embodiments.

The preceding description is exemplary and illustrative in nature rather than being limiting. Variations and modifications to the disclosed example embodiments may become apparent to those skilled in the art that do not necessarily depart from the essence of the invention. The scope of protection provided to the invention can only be determined by studying the following claims.

I claim:

1. An elevator brake device, comprising:

a housing;

a brake member having a braking surface, the brake member being supported by the housing for movement between a disengaged position and an engaged position; and a plurality of buckling beams situated to urge the brake member to apply a braking force wherein the plurality of buckling beams are arranged in a plurality of stacks.

2. The elevator brake device of claim 1, comprising a brake member support, and wherein the brake member support is moveable relative to the housing in a first direction corresponding to movement of the brake member between the disengaged position and the engaged position;

the plurality of buckling beams urge the brake member in a second direction to apply the braking force; and the second direction is generally perpendicular to the first direction.

3. The elevator brake device of claim 1, wherein
each of the plurality of buckling beams comprises a sheet of flexible material;
the sheet has a length, a width, and a thickness;
the length is greater than the width and the width is greater than the thickness; and
the sheet is situated relative to the brake member with the length generally parallel to a direction that the buckling beams urge the brake member to apply the braking force.

4. The elevator brake device of claim 3, wherein each sheet is rectangular.

5. The elevator brake device of claim 3, wherein the thickness is approximately 1% of one of the length or the width.

6. The elevator brake device of claim 3, wherein
each sheet has a rest position in which the sheet is flat and situated in a single plane;
two edges of the sheet are separated by the length in the rest position;
each sheet is deflected into a curved shape with the two edges of the sheet separated by a distance that is less than the length to urge the brake member to apply the braking force.

7. The elevator brake device of claim 3, wherein the flexible material comprises metal.

8. The elevator brake device of claim 3, comprising a brake member support and wherein
the brake member support includes at least one recess facing toward the brake member;
the brake member includes at least one recess on a side facing opposite the braking surface;
the plurality of buckling beams include a first edge situated in the recess on the brake member support and a second, opposite edge situated in the recess on the brake member; and
a distance between the first and second edges is less than the length.

9. The elevator brake device of claim 1, wherein the buckling beams provide a consistent force in a direction of urging the brake surface to apply the braking force.

10. The elevator brake device of claim 1, wherein the plurality of buckling beams includes at least 100 bucking beams.

11. The elevator brake device of claim 1, comprising
a tensioning member received against at least one of the plurality of buckling beams in a position where the tensioning member maintains at least some of the plurality of buckling beams in a deflected state.

12. The elevator brake device of claim 1, wherein the buckling beams each comprise a sheet of flexible material comprising at least one of metal or carbon.

13. The elevator brake device of claim 12, wherein the buckling beams each comprise-a carbon and are made by pultrusion.

14. The elevator brake device of claim 1, wherein each of the buckling beams comprises a sheet of flexible material that has a preselected curvature in a rest condition.

15. The elevator brake device of claim 1, wherein
the brake member support is moveable relative to the housing in a first direction corresponding to movement of the brake member between the disengaged position and the engaged position;
the plurality of buckling beams urge the brake member in a second direction to apply the braking force; and
the second direction is generally perpendicular to the first direction.

16. An elevator brake device, comprising:
a housing;
a brake member having a braking surface, the brake member being supported by the housing for movement between a disengaged position and an engaged position;
a plurality of buckling beams situated to urge the brake member to apply a braking force; and
a force applying assembly including the plurality of buckling beams and a plurality of arms, wherein the buckling beams are situated to urge first ends of the arms away from each other and second, opposite ends of the arms toward each other.

17. The elevator brake device of claim 16, wherein the plurality of arms are situated relative to the brake member such that the second ends of the arms urge the brake member in a direction to apply the braking force.

18. The elevator brake device of claim 16, comprising
a tensioning member having a strut between the arms closer to the first ends of the arms than the second ends of the arms, the tensioning member including at least one structural element in contact with at least one of the buckling beams to deflect at least some of the buckling beams in a desired direction.

19. The elevator brake device of claim 16, wherein
each of the arms includes at least one recess near the first end; and
the buckling beams have edges received in the recesses, respectively.

20. An elevator brake device, comprising:
a housing;
a brake member having a braking surface, the brake member being supported by the housing for movement between a disengaged position and an engaged position;
a brake member support; and
a plurality of buckling beams situated to urge the brake member to apply a braking force,
wherein
each of the plurality of buckling beams comprises a sheet of flexible material;
the sheet has a length, a width, and a thickness;
the length is greater than the width and the width is greater than the thickness;
the sheet is situated relative to the brake member with the length generally parallel to a direction that the buckling beams urge the brake member to apply the braking force
the brake member support includes at least one recess facing toward the brake member;
the brake member includes at least one recess on a side facing opposite the braking surface;
the plurality of buckling beams include a first edge situated in the recess on the brake member support and a second, opposite edge situated in the recess on the brake member; and
a distance between the first and second edges is less than the length.

* * * * *